US006564854B1

(12) United States Patent
Sakate et al.

(10) Patent No.: US 6,564,854 B1
(45) Date of Patent: May 20, 2003

(54) PARTS FORMED BY INJECTION MOLDING AND MANUFACTURING METHOD THEREOF

(75) Inventors: Nobuo Sakate, Hiroshima (JP); Shoji Hirabara, Kure (JP); Kazuo Sakamoto, Hiroshima (JP); Yukio Yamamoto, Hiroshima (JP)

(73) Assignee: Mazda Motor Corporation, Hiroshima (JP)

( * ) Notice: Subject to any disclaimer, the term of this patent is extended or adjusted under 35 U.S.C. 154(b) by 0 days.

(21) Appl. No.: 09/474,747

(22) Filed: Dec. 29, 1999

Related U.S. Application Data

(62) Division of application No. 08/688,004, filed on Jul. 29, 1996, now abandoned.

(30) Foreign Application Priority Data

Jul. 28, 1995 (JP) ..... 7-192944
Mar. 29, 1996 (JP) ..... 8-077748

(51) Int. Cl.[7] ..... B22D 27/09
(52) U.S. Cl. ..... 164/113; 164/900
(58) Field of Search ..... 164/900, 113, 164/312

(56) References Cited

U.S. PATENT DOCUMENTS 4,340,109 A * 7/1982 Roddy ..... 164/97
4,434,837 A 3/1984 Winter et al. ..... 164/468
4,977,947 A 12/1990 Boswell et al. ..... 164/71.1
4,998,574 A 3/1991 Dwividi et al. ..... 144/241
5,303,682 A 4/1994 Donahue et al. ..... 123/193.1
5,404,930 A 4/1995 Stanton et al. ..... 164/122.1
5,531,261 A * 7/1996 Yoshida et al. ..... 164/113
5,553,657 A 9/1996 Aghajanian et al. ..... 164/97
5,638,889 A * 6/1997 Sugiura et al. ..... 164/319
5,693,158 A * 12/1997 Yamamoto et al. ..... 148/557

FOREIGN PATENT DOCUMENTS

| | | |
|---|---|---|
| EP | 574141 | * 12/1993 |
| JP | 62-3864 | * 1/1987 |
| JP | 3-5063 | * 1/1991 |
| JP | 3-107431 | 5/1991 |
| JP | 6-246420 | 9/1994 |
| JP | 06297127 | * 10/1994 |
| JP | 7-256427 | 10/1995 |
| JP | 8-120390 | 5/1996 |
| WO | WO-90/09251 | * 8/1987 |
| WO | 90/09251 | 8/1990 |

OTHER PUBLICATIONS

Journal of Japan Institute of Light Metals (vol. 45, Oct., 10, 1995) (with partial translation at pp. 560–562).
Office Action dated Dec. 20, 2002 of basic Japanese Patent Application No. 8–077748.
Partial English translation of JPA 8–120390, paragraphs 13 through 15.

* cited by examiner

*Primary Examiner*—M. Alexandra Elve
*Assistant Examiner*—Len Tran

(57) ABSTRACT

In a semi-solid alloy including a large amount of a liquid phase portion, that is, semi-solid alloy with less than 50% of solid phase rate, there is a tendency for a solid phase portion to concentrate into the central portion in the direction of thickness, that is the internal portion. In order to enhance corrosion resistance at a portion where high corrosion resistance is particularly required in parts molded by semi-solid injection, the above tendency is utilized. By utilizing the tendency, a layer consisting of a liquid phase portion is partially formed at the semi-solid state on a surface portion where high corrosion resistance is required.

9 Claims, 17 Drawing Sheets

FIG. 6

| ALLOY | MANUFACTURING METHOD | HEATING PROCESS | SURFACE FINISHING PROCESS |
|---|---|---|---|
| AZ91D | INJECTION MOLDING (CONVENTIONAL METHOD) | F (WITHOUT FINISHING PROCESS) | SURFACE WITHOUT FINISHING PROCESS |
| | INJECTION MOLDING (PRESENT EMBODIMENT) | F (WITHOUT FINISHING PROCESS) | SURFACE WITHOUT FINISHING PROCESS |
| | DIE CASTING | F (WITHOUT FINISHING PROCESS) | SURFACE WITHOUT FINISHING PROCESS |

F : HEATING PROCESS COMPLYING WITH JIS

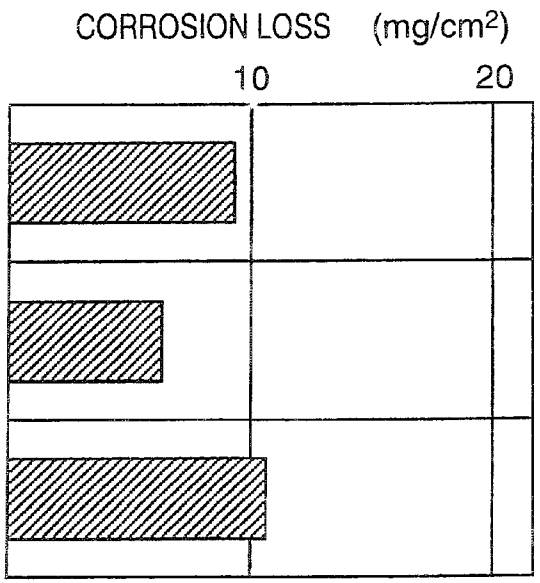

| ALLOY | MANUFACTURING METHOD | HEATING PROCESS | SURFACE FINISHING PROCESS |
|---|---|---|---|
| AZ91D | INJECTION MOLDING (WITHOUT FILTER) | T6 | NO FINISHING PROCESS |
| | | | POLISHING PROCESS WITH EMERY PAPER #600 |
| | INJECTION MOLDING (WITH FILTER) | T6 | NO FINISHING PROCESS |
| | | | POLISHING PROCESS WITH EMERY PAPER #600 |

| ALLOY | MANUFACTURING METHOD | HEATING PROCESS | SURFACE FINISHING PROCESS |
|---|---|---|---|
| AZ91D | CONVENTIONAL INJECTION MOLDING (WITHOUT FILTER) | T6 | NO FINISHING PROCESS |
| | | | POLISHING PROCESS WITH EMERY PAPER #600 |
| | INJECTION MOLDING ACCORDING TO PRESENT EMBODIMENT (WITH FILTER) | T6 | NO FINISHING PROCESS |
| | | | POLISHING PROCESS WITH EMERY PAPER #600 |

FIG. 11

REMAINDER IS Mg UNIT WEIGHT %

| ALLOY No. | Al | Zn | Mn |
|---|---|---|---|
| 1 | 6.1 | 0.9 | 0.27 |
| 2 | 7.0 | 0.7 | 0.27 |
| 3 | 8.1 | 0.7 | 0.22 |
| 4 | 9.1 | 1.0 | 0.31 |

IMPURITY (WEIGHT %)
Fe 0.005% OR LESS
Si 0.05% OR LESS
Ni 0.01% OR LESS
Cu 0.03% OR LESS

FIG. 19

REMAINDER IS Mg UNIT WEIGHT %

| ALLOY No. | Al | Zn | Mn |
|---|---|---|---|
| 5 | 5.5 | 0.85 | 0.25 |
| 6 | 6.5 | 0.91 | 0.26 |
| 7 | 7.5 | 0.78 | 0.23 |
| 8 | 9.5 | 0.88 | 0.25 |

IMPURITY (WEIGHT %)
Fe 0.005% OR LESS
Si 0.05% OR LESS
Ni 0.001% OR LESS
Cu 0.003% OR LESS

REMAINDER IS Al UNIT WEIGHT %

| Si | Cu | Mg | Ni | Fe |
|---|---|---|---|---|
| 8.5 | 1.0 | 0.8 | 1.8 | 0.1 |

PARTS FORMED BY INJECTION MOLDING AND MANUFACTURING METHOD THEREOF

This application is a divisional of application number 08/688,004, filed Jul. 29, 1996 now abandoned.

BACKGROUND OF THE INVENTION

Present invention relates to parts formed by injection molding with semi-solid particulate metal or alloy and manufacturing method thereof. More particularly, when semi-solid particulate metal is injected into a mold to form parts in a desired shape, it is arranged such that a liquid phase of the semi-solid particulate metal is distributed to a surface portion of the parts and a solid phase of the semi-solid particulate metal is distributed to an internal portion of the parts, so that each of the physical properties of the material, attributed to each chemical composition of the liquid phase portion and solid phase portion, can be utilized as a function of the parts.

Generally, parts manufactured by die casting or gravity casting (casting by slowly pouring molten raw material into a cast) with aluminum and magnesium alloy as raw materials have virtually homogeneous chemical composition on the surface and inside, and the material characteristic rarely changes. Therefore, characteristics such as wear resistance and corrosion resistance required on a surface of molded parts are usually different from high flexibility or the like required for an internal portion of the parts, and it is considered difficult to attain both characteristics simultaneously.

In contrast, a technique has been proposed to partially provide wear resistance to molded parts, where a rigid porous material such as ceramic fiber or the like is located at a predetermined position inside a mold and a molten alloy is poured into the mold and pressed inside the mold to compound the porous material with the molded parts.

Moreover, it is a well-known technique which enables SiC (silicon carbide) particles to be concentrated at a particular portion with high density by setting a filter at a predetermined position inside a mold, pouring a molten alloy into the mold and pressing the molten alloy inside the mold, where large particles such as non-metal material or the like are scattered, to be molded (Japanese Patent Application Laid-Open No. 3-5063).

Furthermore, a method has been suggested where magnesium alloy material is half molten to have a solid phase rate of 60% or less, injected to a mold to form a cast product, and then a plasticizing process is performed thereon to form a molded product (Japanese Patent Application Laid-Open No. 6-297127).

In the foregoing injection molding with semi-solid particulate metal (hereinafter referred to as semi-solid injection molding), semi-solid alloy includes both a solid phase portion and a liquid phase portion, each of which has different chemical compositions and has the following characteristics. That is:

① In aluminum-magnesium (hereinafter referred to as Al—Mg) magnesium alloys, the solid phase portion has a small amount of aluminum (hereinafter referred to as Al) component, and the liquid phase portion has a large amount of Al component;

② In aluminum-silicon (hereinafter referred to as Al—Si) aluminum alloys, the solid phase portion has a small amount of silicon (hereinafter referred to as Si) component, and the liquid phase portion has a large amount of Si component.

In the above described technique for partially providing wear resistance to molded parts, since the porous material needs to be preliminarily heated or to be maintained at more than a predetermined temperature in order be located in a mold, such processing causes a reduction in production efficiency.

Further, in the semi-solid injection molding, compositions of the material one different in the solid phase portion and the liquid phase portion. It is possible to change characteristics of the material on the surface and inside portion of molded parts by varying the arrangement of the solid phase portion and liquid phase portion. However, there has been no art suggested to positively achieve the above.

For instance, when the semi-solid injection molding is applied to Al—Mg magnesium alloys, a liquid phase portion which has relatively large amount of Al component tends to exist in the surface of molded parts. Although this characteristic can be utilized to provide corrosion resistance to the surface, there has been no art suggested to constructively arrange Al component included in the liquid phase portion to a portion where high corrosion resistance is required. Therefore, corrosion of parts could not be further prevented.

SUMMARY OF THE INVENTION

The present invention has been made in consideration of the above situation, and has as its object to provide parts formed by injection molding with semi-solid material and manufacturing method thereof for constructively arranging a liquid phase portion to those portions that require high corrosion resistance such as a surface of parts formed by semi-solid injection molding, in order to enhance corrosion resistance and wear resistance, and to readily obtain molded parts having different material characteristics between a surface portion and an internal portion.

In order to solve the above problem and attain the foregoing objective, the present invention provides a manufacturing method of parts molded by injecting half-molten alloy material including a solid phase portion and a liquid phase portion into a mold, characterized in that a layer comprising the liquid phase portion is partially formed in a predetermined portion of the parts.

Further, parts molded by semi-solid injection molding according to the present invention have the following characteristic. That is, the parts are molded by injecting semi-solid alloy material including a solid phase portion and a liquid phase portion into a mold, and characterized in that a layer comprising of the liquid phase portion is partially formed in a predetermined portion of the parts.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 6 is a chart showing results of a salt spray test (SST) experimented upon the corrosion test piece which is manufactured by the method according to the first embodiment;

FIG. 11 is a chart showing chemical compositions for four types of Al—Mg magnesium alloys which are molded by the conventional injection method with various Al component, and on which a tension test and an impact test are to be experimented;

FIG. 19 is a chart showing chemical compositions for four types of Al—Mg magnesium alloys which are molded by the injection method according to the first and second embodiments with various Al component, and on which a tension test and an impact test are to be experimented;

DETAILED DESCRIPTION OF THE PREFERRED EMBODIMENTS

Preferred embodiments of the present invention will be described in detail in accordance with the accompanying drawings.

<Principle of Manufacturing Method>

Figure 1:
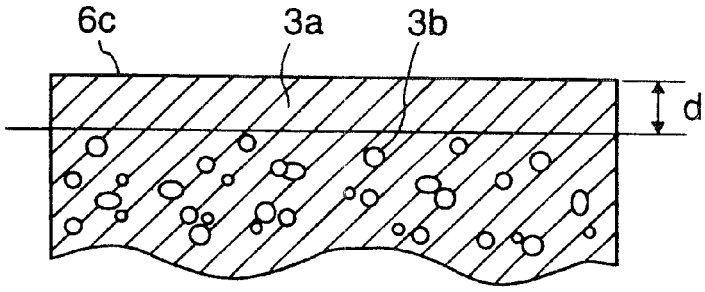
FIG. 1 is a cross-sectional view illustrating typical texture of a comparison test piece molded by semi-solid injection molding.
Figure 2:
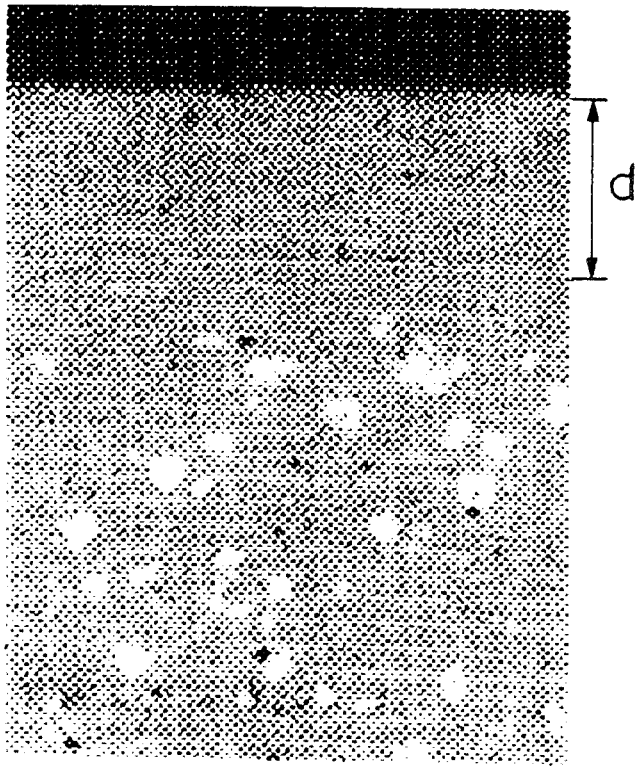
FIG. 2 is a photomicrograph showing a cross-section of actual texture of the comparison test piece formed by the semi-solid injection molding.

First, principle of the manufacturing method for parts molded by semi-solid injection molding according to the present embodiment will be explained. FIG. 1 shows a cross-sectional view of typical texture of a comparison test piece molded by semi-solid injection molding. FIG. 2 is a photomicrograph showing a cross-section of actual texture of the comparison test piece formed by the semi-solid injection molding.

In relation to a semi-solid alloy with a large amount of liquid phase, that is, a semi-solid alloy having 50% or less of a solid phase rate {=solid phase quantity/(solid phase quantity+liquid phase quantity)}, the solid phase portion and the liquid phase portion are arranged relatively homogeneously in the thickness direction of thin molded parts (5 mm or thinner) such as those molded by a normal die casting. However, for thick molded parts, the solid phase portion tends to concentrate towards the center, that is the internal portion, in the thickness direction. This is caused by a phenomenon that attributes to the difference in fluidity between the solid phase portion and liquid phase portion in the mold.

The parts molded by the semi-solid injection molding according to the present embodiment are molded by utilizing the above described phenomenon. Inventors of the present invention have discovered that the phenomenon is influenced by the relationship between a particle size of a solid phase and a thickness of molded parts in a semi-solid state, and that the smaller the particle size of the solid phase, as compared to the thickness of the molded parts, the greater the tendency for the solid phase portion to concentrate in the internal portion. Note that the particle size of the solid phase is an average size of all the particles included in the solid phase portion.

<Configuration of Semi-Solid Injection Molding Machine>

Figure 3:
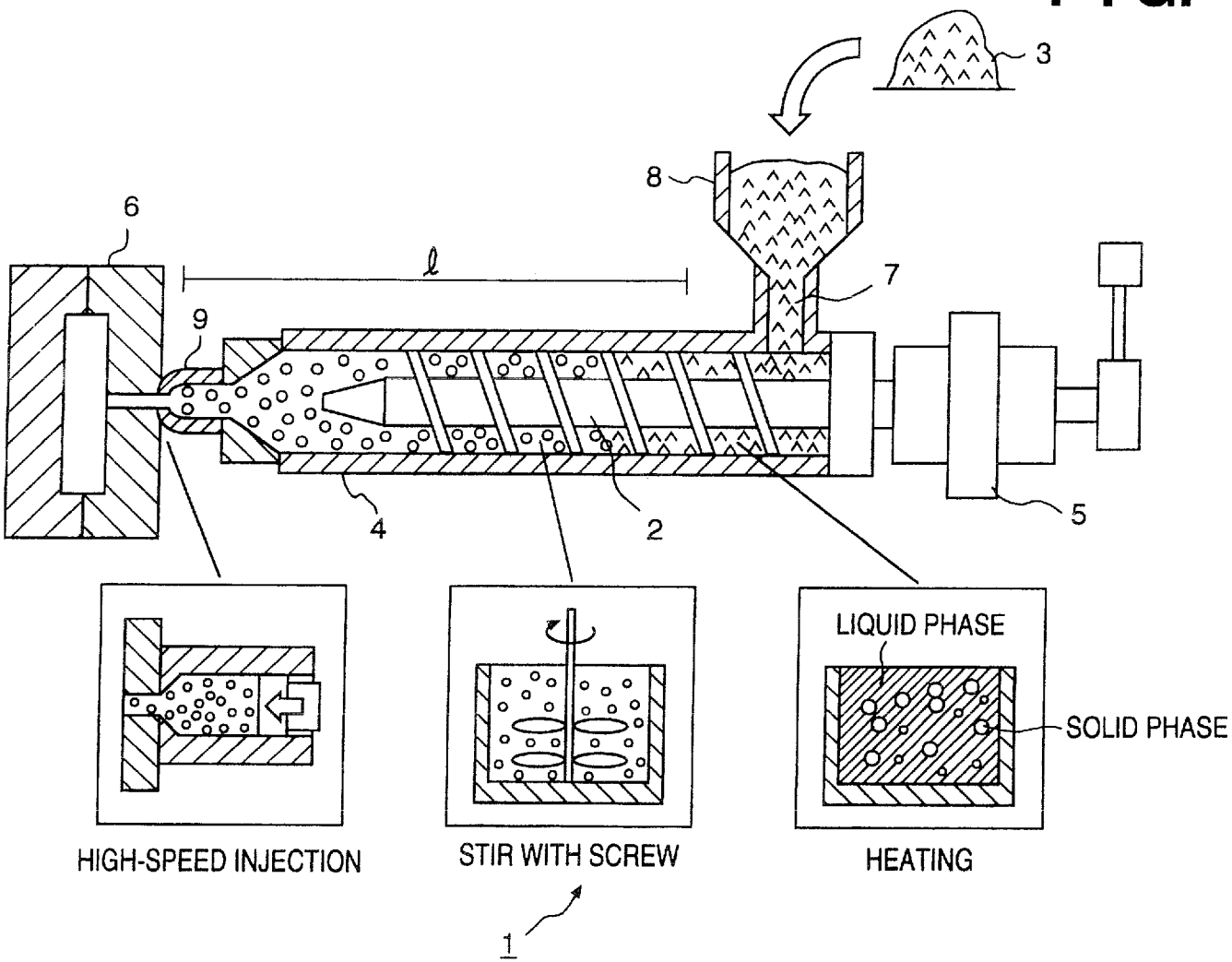
FIG. 3 is a schematic view showing a main part of a semi-solid injection molding machine according to an embodiment of the present invention.

FIG. 3 shows a schematic view of a main part of the semi-solid injection molding machine according to the present embodiment.

A brief description of a screw-type half-molten injection molding machine utilized in the present embodiment will be provided with reference to FIG. 3. In the figure, a screw-type injection molding machine 1 rotates a screw 2 to send raw material 3 to a heating cylinder 4, and the raw material 3 is stirred by the screw 2, sufficiently mixed and heated to be brought into a semi-solid state. As the semi-solid raw material 3 is pushed forward to the front of the screw 2, the pressure pushes the screw 2 to retreat. As another method of retreating the screw without using the pressure of the raw material, the screw can be forced to retreat with arbitrary speed. A high-speed injection mechanism 5 detects the retreat when the screw 2 retreats for a predetermined length, stops the rotation of the screw, and at the same time, stops the retreat of the screw. The quantity of the raw material 3 can be determined by setting the retreated distance of the screw 2. By pushing the screw 2 forward by the high-speed injection mechanism 5, the semi-solid raw material 3 is injected from a nozzle 9 to a mold 6. The material 3 is magnesium pellet which will be described later, and sent from a hopper 8 to the cylinder 4. Argon gas is filled in a path 7 connecting the hopper 8 to the cylinder 4. Oxidation of the raw material (such as magnesium pellet) is prevented by disposing the raw material in the argon atmosphere.

According to the above described screw-type molding machine 1, raw material can be homogeneously heated in a heating zone | inside the heating cylinder 4 by virtue of the screw 2 stirring the material and mixing sufficiently.

[First Embodiment of Manufacturing Method for Parts Molded By Semi-Solid Injection Molding]

Figure 4:
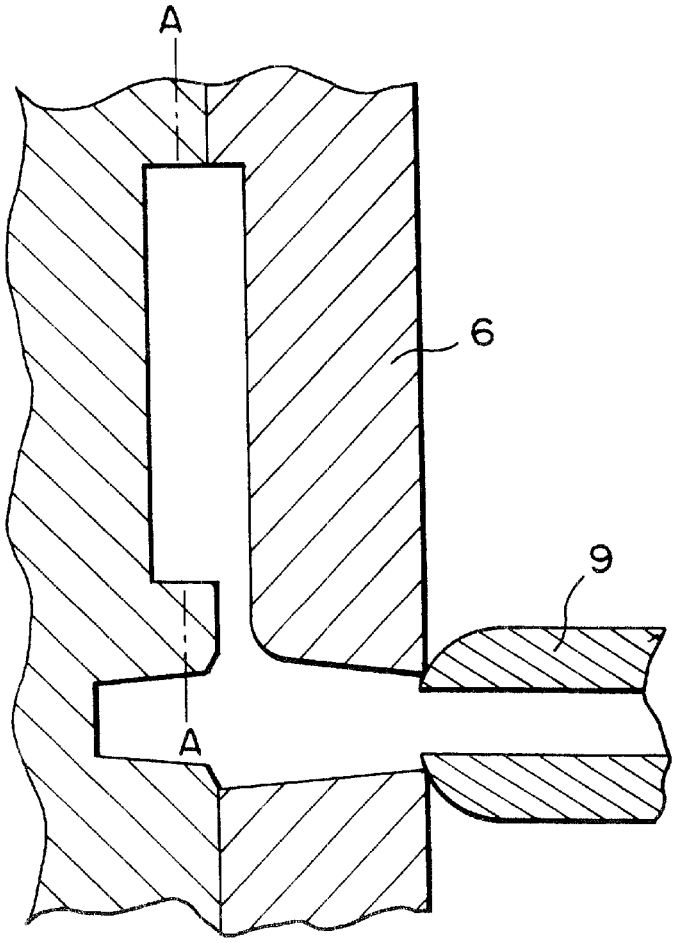
FIG. 4 is a cross-sectional view showing a method of manufacturing a corrosion test piece applying the manufacturing method according to a first embodiment.
Figure 5:
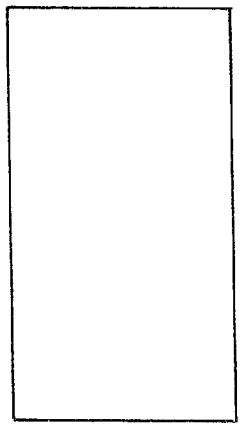
FIG. 5 is a cross-sectional view cut along the A—A line in FIG. 4.

Next, as a first embodiment, descriptions will be provided for a manufacturing method of parts molded by semi-solid injection molding without utilizing a filter (in a second embodiment, with a filter), but by manipulating the size and arrangement of particles of the solid phase. FIG. 4 illustrates a method of manufacturing a corrosion test piece applying the manufacturing method according to the first embodiment. FIG. 5 shows a cross-section cut along the A—A line in FIG. 4. FIG. 6 shows results of a salt spray test (SST) experimented upon the corrosion test piece which is manufactured by the method according to the first embodiment.

Referring to FIGS. 4 to 6, the corrosion test piece used in the first embodiment is molded by injecting semi-solid material from the nozzle 9 into the mold 6, while satisfying the following conditions. Results of the salt spray test experimented upon a comparison test piece which is manufactured by the conventional injection molding and results of the salt spray test experimented upon another comparison test piece manufactured by die casting, are shown in FIG. 6 for a comparison purpose.

(Conditions for Manufacturing)

Material: AZ91D alloys complying with the American Society for Testing and Materials (hereinafter referred to as ASTM Standard)

(Salt Spraying Condition)

Salted water: 5 wt % NaCl (sodium chloride)

Temperature: 35° C.

Duration: 1000 hours (Method of Manufacturing)

Injection molding by the conventional method:

A test piece is molded with a solid phase rate of approximately 25% utilizing the injection molding machine-shown in FIG. 3, to obtain the particle size of a solid phase of approximately 100 to 150 μm.

Injection molding according to the present embodiment:

A test piece is molded so that a solid phase rate is approximately 25%. When material pellets are produced by machine processing, material pellets which have been plasticized before the process is utilized to obtain finely granulated particle size of the solid phase, that approximately 50 to 80 μm.

Die Casting:

A test piece is molded by a regular cold-chamber-type die casting machine.

<Results of Corrosion Test>

As shown in FIG. 6, according to the manufacturing method of the first embodiment, corrosion resistance is improved by granulating the particles of the solid phase of an alloy as a material more finely than the conventional material.

<Method of Finely Granulating Solid Phase Particles>

Hereinafter, an explanation will be given for the method of finely granulating the solid phase particles to less than one fiftieth of the thickness of molded parts.

A particle size of the solid phase obtained at the time of heating semi-solid alloy material depends upon a particle size of the pelletized crystal. In other words, the smaller the size of crystal, the smaller the size of a solid phase particle becomes. Therefore, the solid phase particle can be finely granulated by performing plasticizing process (e.g. rolling process, forging process or the like) on solid alloy as a base material, which is the alloy material before cutting into pellets.

Further, granulating of the crystal particle can be realized by adding CaCN2 (calcium cyanide) or Sr (strontium) at the time of producing the solid alloy as a base material.

Moreover, Sr (strontium) effectively prevents the solid phase particle from gradually coarsening, which results from alloy material staying inside an injection molding machine and being kept in a semi-solid state for a long period of time.

[Second Embodiment of Manufacturing Method for Parts Molded By Semi-Solid Injection]

Next, as a second embodiment, descriptions will be provided for a manufacturing method of parts molded by semi-solid injection molding utilizing a filter.

Figure 7:
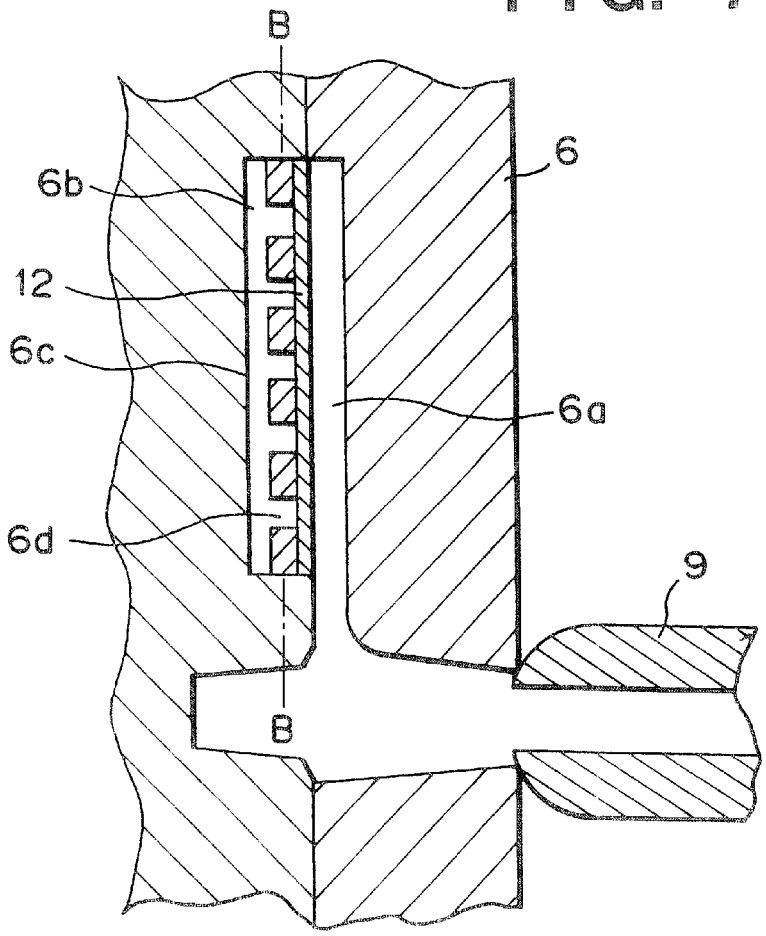
FIG. 7 is a cross-sectional view illustrating a molding method of the corrosion test piece which applies semi-solid injection molding according to a second embodiment.
Figure 8:
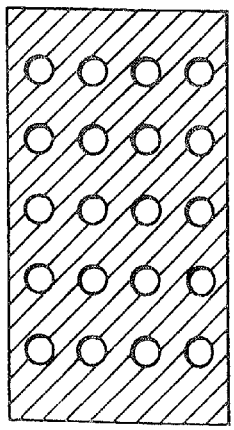
FIG. 8 is a cross-sectional view cut along the B—B line in FIG. 7.

FIG. 7 illustrates a molding method of the corrosion test piece applying semi-solid injection molding according to the second embodiment, and FIG. 8 is a cross-sectional view cut along the B—B line in FIG. 7.

In the second embodiment, attention has been given on the following points:

① In Al—Mg magnesium alloys, a solid phase portion has a small amount of Al component, and a liquid phase portion has large amount of Al component;

② In Al—Si aluminum alloys, a solid phase portion has a small amount of Si component, and a liquid phase portion has a large amount of Si component.

In order to improve corrosion resistance and wear resistance by constructively arranging the liquid phase portion to those portions that require high corrosion resistance and wear resistance such as a surface portion, a filter 12 which partitions the mold 6 into cavities 6*a* and 6*b* is utilized (see FIG. 7). The filter 12 is a porous material (e.g. foamed nickel) of which pore is smaller than a particle size of a solid phase portion, that is about 80 μm. The filter 12 traps a solid phase portion of semi-solid metal material injected from the nozzle 9 and passes only a liquid phase portion to the cavity 6*b*.

<Results of Corrosion Test>

Next, corrosion between a corrosion test piece formed by the semi-solid injection molding according to the second embodiment and the comparison test piece formed by the conventional semi-solid injection molding will be compared.

The test piece used in the second embodiment and the comparison test piece are existing magnesium alloy AZ91D, that is identical to the first embodiment, and a portion 6*c* of the cavity 6*b* is an evaluation surface of the corrosion tests. The comparison test piece is formed by semi-solid injection molding utilizing a mold without the filter 12 shown in FIG. 7. As has been described in the "Description of the Related Art," a liquid phase portion 3*a* (see FIG. 1) which has a relatively large amount of Al component tends to gather in the surface of molded parts when formed by semi-solid injection molding. Accordingly, a layer having a thickness d of few μm to 400 μm, solely consisting of the liquid phase portion 3*a*, is formed on the evaluation surface 6*c*, and a layer consisting of both the liquid phase portion 3*a* and solid phase portion 3*b* is formed in the internal portion, as illustrated in FIGS. 1 and 2.

Further, since the solid phase portion 3*b* is trapped by the filter 12 in the test piece according to the second embodiment, the cross-section of its texture contains only the liquid phase portion 3*a*.

Figure 9:
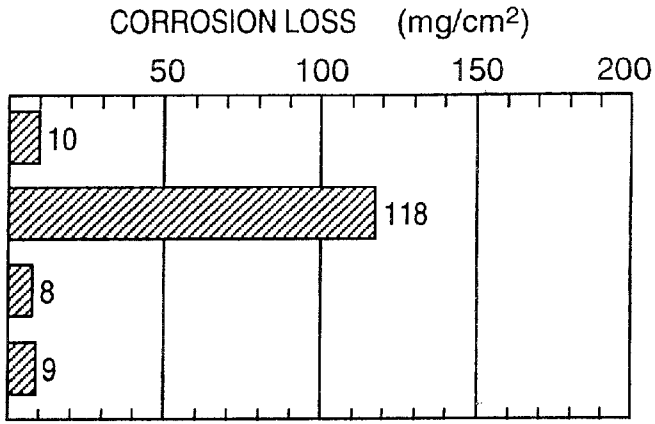
FIG. 9 is a chart showing two types of test pieces on which a heating process T6 complying with the Japanese Industrial Standard (JIS) is performed, each of which is left without a finishing process, and also on which a polishing process is performed using an emery paper with surface roughness of #600; and a graph showing results of the salt spray test (SST) in corrosion loss on the surface of the two types of the test pieces.
Figure 10:
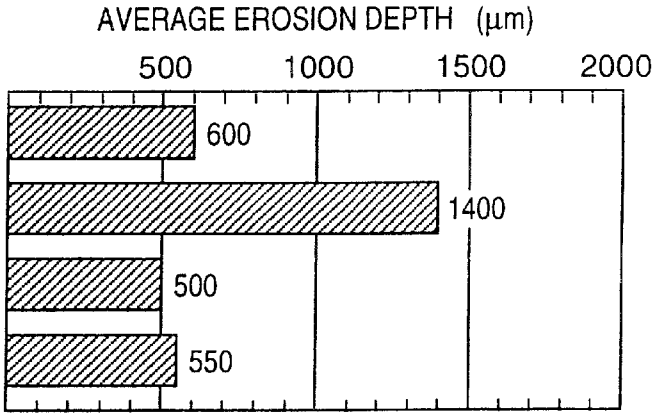
FIG. 10 is a chart showing two types of test pieces on which the heating process T6 is performed, each of which is left without a finishing process, and also on which a polishing process is performed using an emery paper with surface roughness of #600; and a graph showing results of the salt spray test (SST) in average erosion depth on the surface of the two types of the test pieces.

FIG. 9 is a chart showing two types of test pieces on which the heating process T6 complying with JIS is performed, each of which is left without a finishing process, and also on which a polishing process is performed using an emery paper with surface roughness of #600; and a graph showing results of the salt spray test (SST) in corrosion loss on the surface of the two types of the test pieces. FIG. 10 is a chart showing two types of test pieces on which the heating process T6 is performed, each of which is left without a finishing process, and also on which a surface polishing process is performed using an emery paper with surface roughness of #600; and a graph showing results of the salt spray test (SST) in average erosion depth on the surface of the two types of the test pieces. As can be seen from FIGS. 9 and 10, when the experiment is carried out without the filter, results from both tests show that the surface of the test piece having no finishing process has a better result than the test piece with the polishing process using the #600 roughness emery paper. This is due to the polishing process which causes to surface the texture having low aluminum component, which is low in corrosion resistance, formed inside of the test piece by each of the molding.

Note that the process T6 is a heating process that executes an artificial aging process after a solution treatment.

When the test results of the two types of test pieces are compared, the test piece molded according to the second embodiment, where the texture with a large amount of aluminum component is constructively distributed in the surface portion, is superior in both of the cases, with no finishing process and with the polishing process.

By employing the semi-solid injection molding according to the second embodiment for Al—Mg magnesium alloys, the surface of molded parts has better corrosion resistance, high rigidity and improved internal flexibility. Moreover, when Al—Si aluminum alloys are employed, the surface of molded parts achieves improved wear resistance and improved internal flexibility.

[Application to Automobile Wheel]

Next, descriptions will be provided for a case where the semi-solid injection molding according to the first and second embodiments is applied to mold a wheel for an automobile.

Generally speaking, for an automobile wheel where a rim, a hub and a spoke are integrally formed, the less the wheel weighs, the more improved the driving stability is. Therefore, demands are increasing lately for wheels made of an aluminum alloy or of a magnesium alloy.

The surface portion of an automobile wheel requires corrosion resistance. Particularly when a wheel made of a magnesium alloy is manufactured by a casting method such as die casting or the injection molding such as the present embodiment, aluminum-manganese (hereinafter referred to as Al—Mn) magnesium alloys (such as AM60 alloy complying with ASTM Standard) is utilized, since its impact resistance characteristic is important.

From a corrosion resistance point of view, AZ91D alloy complying with ASTM Standard which has a large amount of aluminum content is preferable; however, impact resistance thereof is considerably low. In practice, there is no alloy which satisfies all corrosion resistance, high rigidity characteristic such as yield strength or tensile strength, and flexibility.

In view of this situation, the present embodiment selects alloy components appropriate for an automobile wheel, as described below.

Figure 12:
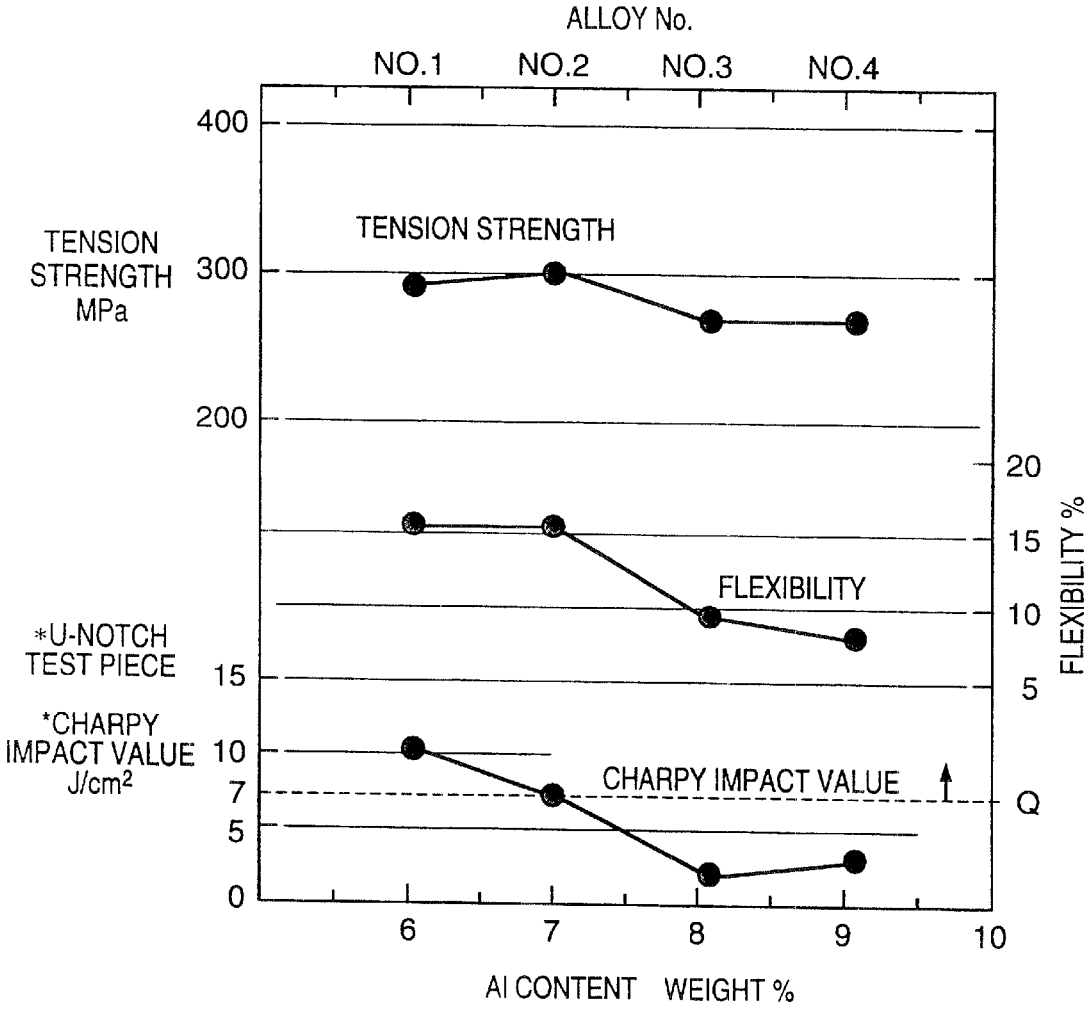
FIG. 12 is a graph showing results of the tension test and impact test experimented upon the four types of alloys shown in FIG. 11.

FIG. 11 shows chemical compositions for four types of Al—Mg magnesium alloys which are molded by the conventional injection molding with various Al components, and on which a tension test and an impact test are to be experimented. FIG. 12 shows results of the tension test and impact test experimented upon the four types of alloys shown in FIG. 11.

Referring to FIGS. 11 and 12, among alloys including aluminum (Al), manganese (Mn) and zinc (Zn), the aluminum component has the most influence over physical characteristics and corrosion resistance, and all the characteristics dramatically deteriorate when aluminum content rises above 7 wt %.

In order to achieve an impact value that is higher than the value necessary for a wheel (7J/cm$^2$ in FIG. 12), it is preferable to set Al contents to less than 7%; however, when Al contents are low, tension strength deteriorates, which results in low rigidity and particularly influences wear resistance on the surface clamped by a nut. Accordingly, it is necessary to partially increase Al contents to increase rigidity in particular portions.

In the present embodiment, the characteristics of the aluminum are taken into consideration, and alloy components are specified to satisfy the foregoing functional elements as molded parts, by employing the semi-solid injection molding described in the first and second embodiments to mold an automobile wheel.

[Application Example of the First Embodiment]

Figure 13:
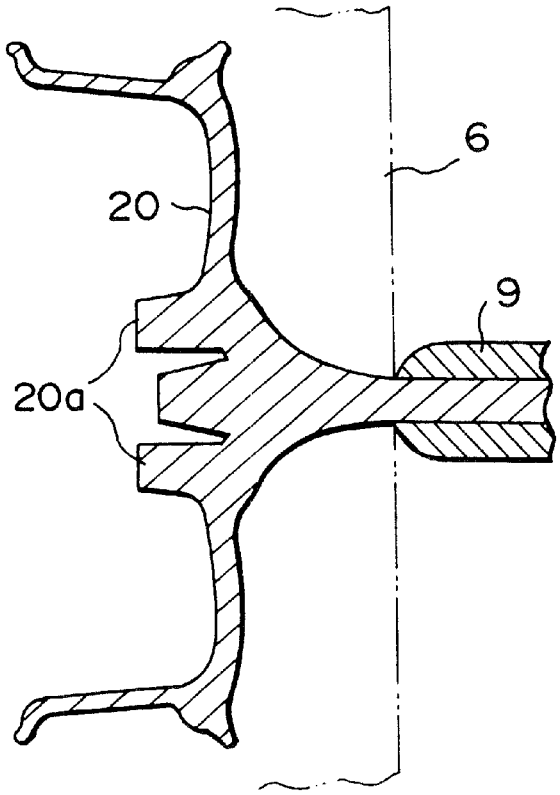
FIG. 13 is a cross-sectional view illustrating a molding method of a wheel for an automobile applying the semi-solid injection molding according to the first embodiment.
Figure 14:
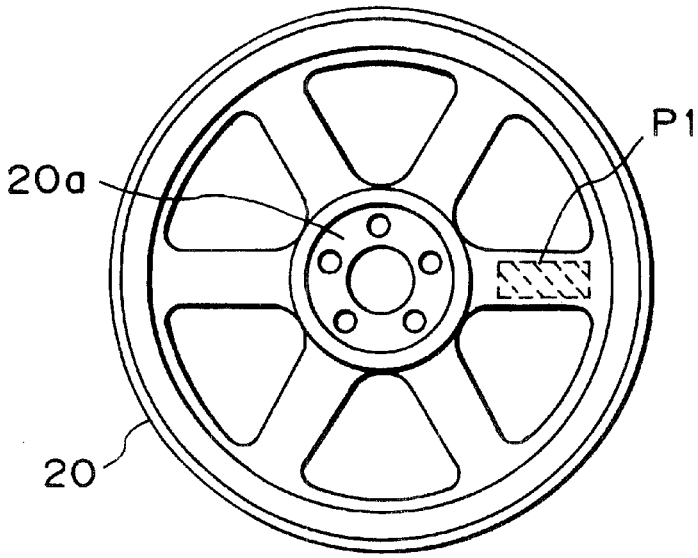
FIG. 14 is an elevational view of a wheel for an automobile molded in accordance with the first embodiment where a mechanical process has been performed thereupon.
Figure 15:
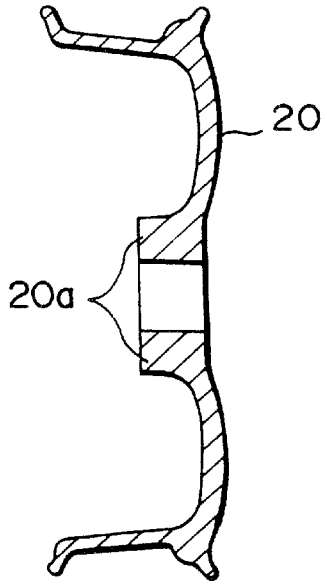
FIG. 15 is a cross-sectional view of FIG. 14.

Next, an application example for molding an automobile wheel employing the semi-solid injection molding according to the first embodiment will be described. FIG. 13 shows a molding of a wheel for an automobile applying the semi-solid injection molding according to the first embodiment. FIG. 14 shows an elevational view of an automobile wheel where a mechanical process has been performed. FIG. 15 is a cross-sectional view of FIG. 14. Note that the following embodiments are also applicable to a clutch drum of an automatic transmission or engine pistons, in addition to an automobile wheel.

Generally, an automobile wheel requires strength and corrosion resistance as a whole, as well as wear resistance on the surface clamped by a nut.

When the first embodiment is applied, a wheel can be molded to have a liquid phase portion concentrated to the surface of the wheel, as shown in FIG. 13. Therefore, it is possible to enhance strength as a whole (such as flexibility and impact strength) by hardening only a nut clamping surface 20*a* of a wheel 20 in FIG. 13. When Al—Mg magnesium alloys are utilized, Al density increases, and when Al—Si aluminum alloys are utilized, Si density increases; and either of the cases can enhance rigidity of the nut clamping surface 20*a*.

[Application Example of the Second Embodiment]

Figure 16:
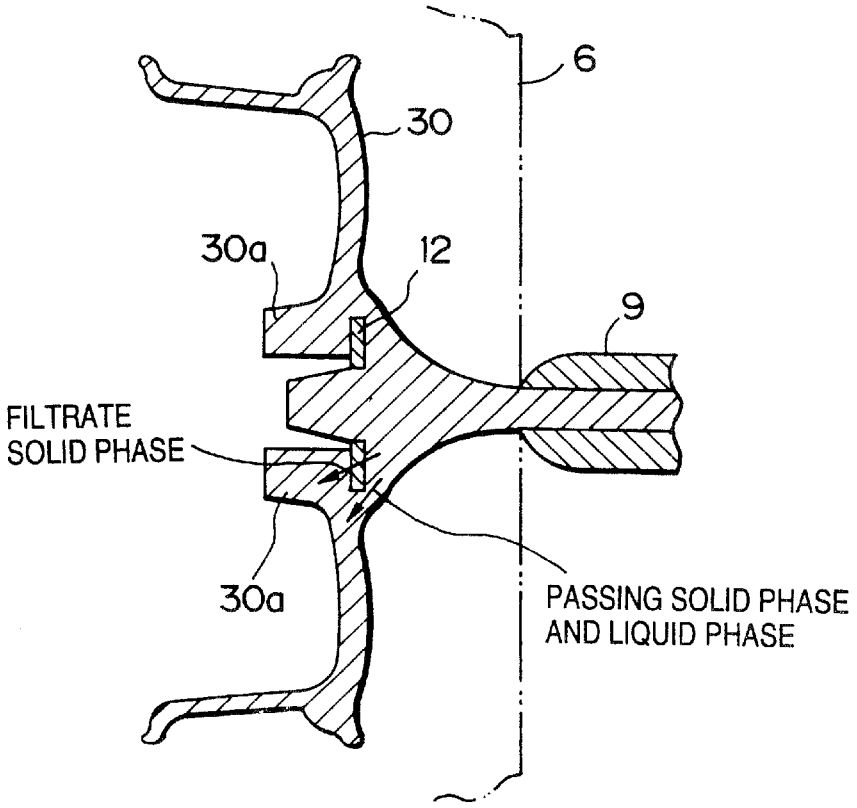
FIG. 16 is a cross-sectional view showing a molding method of a wheel for an automobile applying the semi-solid injection molding according to the second embodiment.
Figure 17:
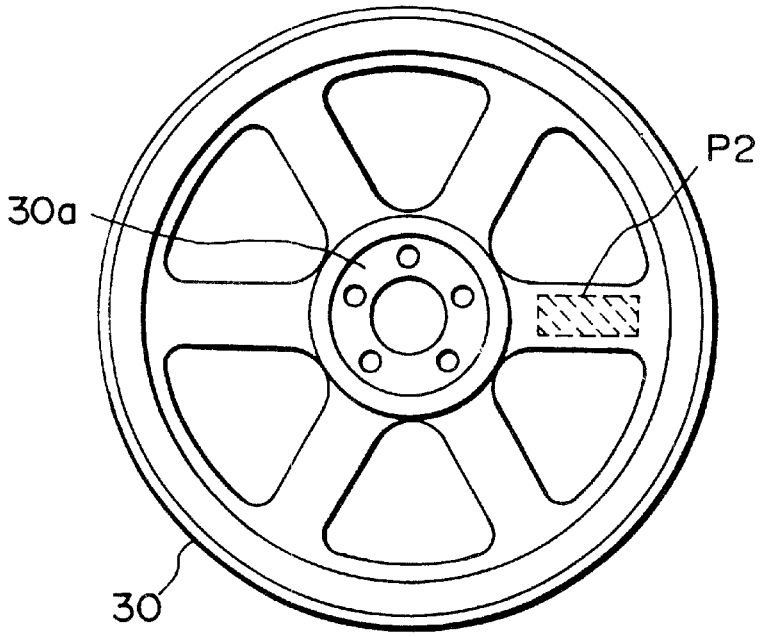
FIG. 17 is an elevational view of a wheel for an automobile molded in accordance with the second embodiment where a mechanical process has been performed thereupon.
Figure 18:
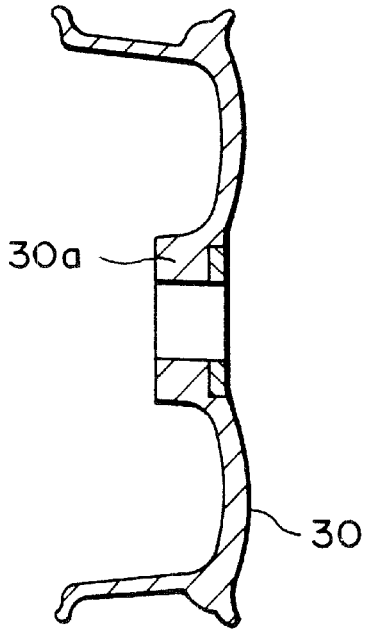
FIG. 18 is a cross-sectional view of FIG. 17.

Next, an application example for molding an automobile wheel employing the semi-solid injection molding according to the second embodiment will be described. FIG. 16 illustrates a molding of an automobile wheel applying the semi-solid injection molding according to the second embodiment. FIG. 17 is an elevational view of an automobile wheel where a mechanical process has been performed. FIG. 18 is a cross-sectional view of FIG. 17.

As shown in FIG. 16, when the second embodiment is applied, the filter 12 is located at a hub portion of the molded parts, which would become the nut clamping surface 30*a* of the hub portion of the wheel, in order to prevent wear on the nut clamping surface at the time of clamping a nut on the hub portion of the automobile wheel. Since the solid phase portion is filtered, the nut clamping surface 30*a* is formed solely with the liquid phase portion. Therefore, it is possible to enhance strength as a whole (such as flexibility and impact strength) by hardening only the nut clamping surface 30*a* of a wheel 30 in FIGS. 17 and 18. When Al—Mg magnesium alloys are utilized, Al density increases, and when Al—Si aluminum alloys are utilized, Si density increases; and either of the cases can enhance rigidity of the nut clamping surface 30*a*.

Further, application of a rigid material for the filter can strengthen the base material when the filter is left inside the molded parts.

For instance, metal or ceramic porous material can be located at a position on which surface is clamped by a nut, so that it can function as a filter and also can be utilized as a reinforcement material after being molded to prevent wear.

[Effect of Applying the Present Embodiment to Automobile Wheel and Selection of Alloy]

Figure 20:
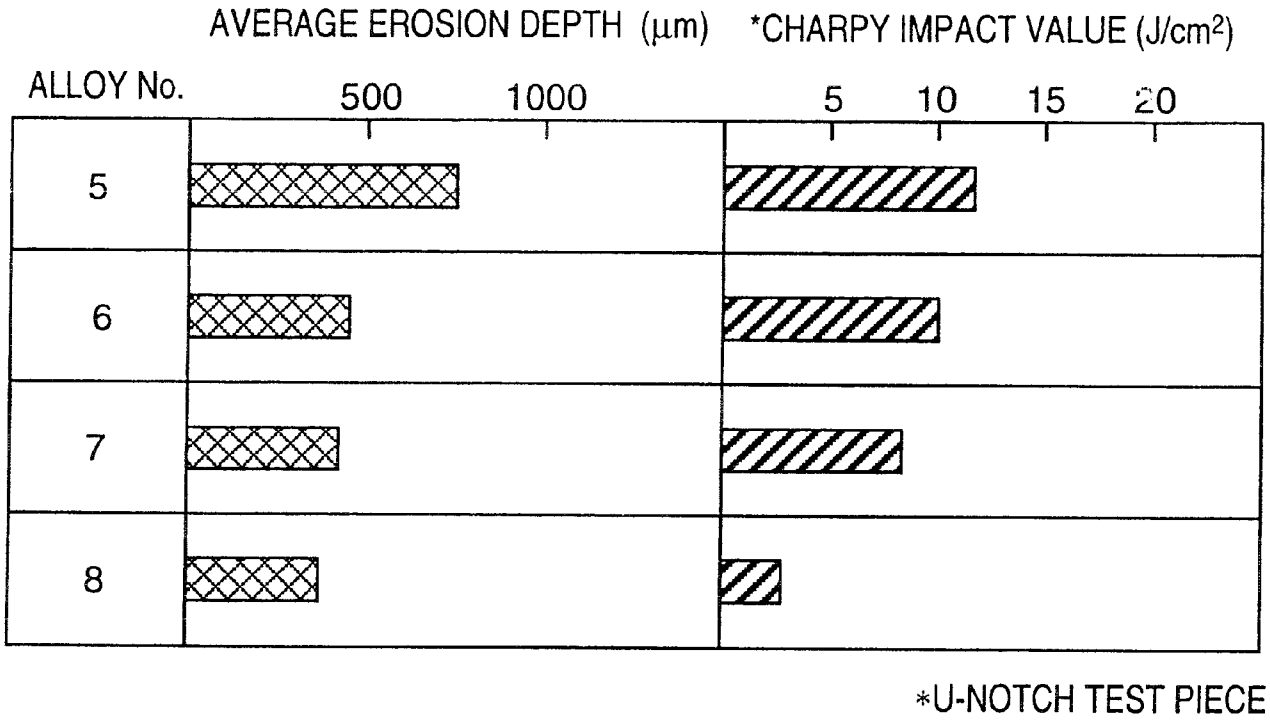
FIG. 20 is a chart showing results of the corrosion test and impact test experimented upon the four types of alloys shown in FIG. 19.

FIG. 19 shows chemical compositions for four types of Al—Mg magnesium alloys on which a tension test and an impact test are to be experimented. FIG. 20 shows results of the corrosion test and impact test experimented upon the four types of alloys shown in FIG. 19.

Note that the specification of the molded parts is set as follows.

Wheel disc: minimum thickness of 5 mm (thickness in spoke portion is 15 mm)

Size of a solid phase particle: 80 $\mu$m

The test results shown in FIG. 20 are based on an automobile wheel molded with the four types of Al—Mg magnesium alloys shown in FIG. 19. A corrosion resistance test is performed on the test pieces taken from P1 (FIG. 14) and P2 (FIG. 17) of a disc surface and the Charpy impact test is performed on the internal portion of the spoke. FIGS. 19 and 20 demonstrate how Al contents affect the corrosion resistance and physical characteristics of each alloy. FIG. 20 shows that the alloys having high corrosion resistance and high impact resistance is are "No. 5" and "No. 6" alloys in FIG. 19, and indicates that the range of 6.5 wt % to 7.5 wt % of Al contents is preferable.

When a filter is utilized as shown in FIG. 16, Al contents may be more than 7.5 wt % since a solid phase portion can be arbitrarily arranged without considering a cross-sectional thickness of molded parts, but no higher than 10 wt % since it also causes the Al to increase in the solid phase portion.

[Relationship with Silicon Contents]

Figure 21:
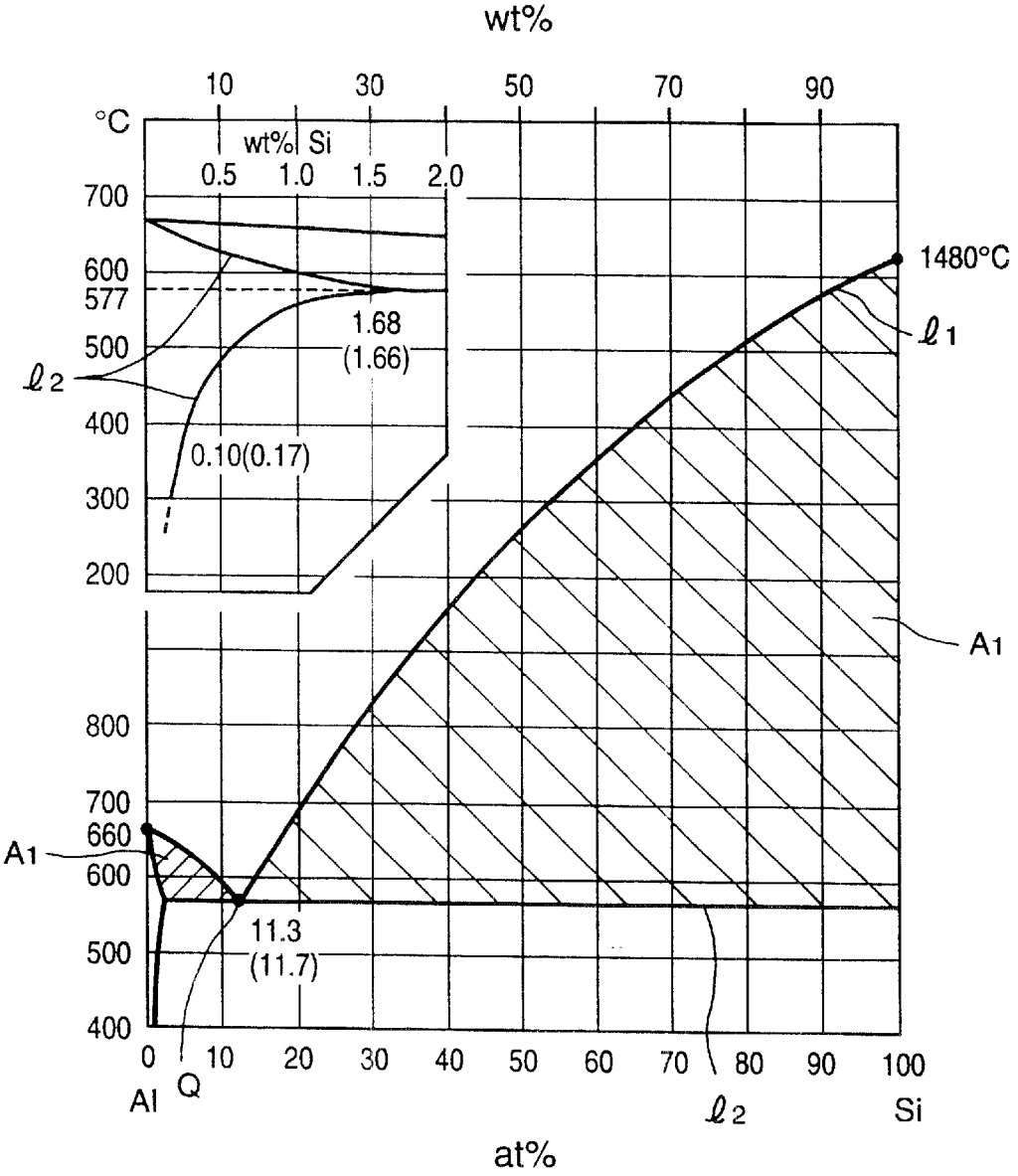
FIG. 21 is a graph illustrating a state of Al—Si aluminum alloys.

Next, the relationship with silicon contents will be described. FIG. 21 illustrates a state of equilibrium of a liquid phase portion and a solid phase portion included in Al—Si aluminum alloys based on a temperature, weight % (wt %) and atomic % (at %) of silicon contents.

As shown in FIG. 21, a dotted line $|_1$ denotes variance of the liquid phase (hereinafter referred to as liquidus $|_1$), and a solid line $|_2$ denotes variance of the solid phase (hereinafter referred to as solidus $|_2$). An intersection point Q of the liquidus $|_1$ and the solidus $|_2$ denotes an eutectic point (hereinafter referred to as eutectic point Q). Further, an area $A_1$ between the liquidus $|_1$ and the solidus $|_2$ denotes an area where aluminum alloy is semi-solid. Values in parenthesis indicated near the liquidus $|_1$, solidus $|_2$ and near the eutectic point Q denote silicon contents by weight % (wt %) and values outside the parenthesis denote silicon contents by atomic % (at %).

The Si contents at the eutectic point Q is 11.3 at % and 11.7 wt %, that is about 12 wt %. In a semi-solid state where a fusing point of eutectic compositions is the lowest, the eutectic compositions become liquid phase and arranged in the surface portion. The solid phase portion having a small amount of Si content is arranged in the internal portion of the parts, providing flexibility. In order to have the above configuration, Si content must be less than about 12 wt % (if Si content is less than 12 wt %, compositions of the internal portion of the parts include a large amount of Si content). Moreover, when Si content is less than about 6 wt %, it becomes difficult to compose the surface portion with an eutectic composition or a composition having a large amount of Si content. Accordingly, when Al—Si aluminum alloys are utilized in the above described first and second embodiments, a layer having a large amount of Si is formed in a liquid phase portion particularly when Si content are at least 6 to 12 wt %, resulting an increase in rigidity in the surface portion and flexibility in the inside portion.

Figures 22, 23:
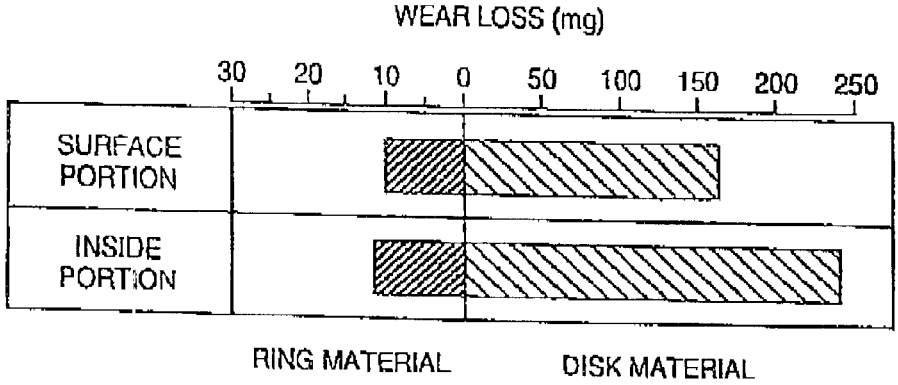
FIG. 22 is a chart showing chemical compositions of Al—Si aluminum alloys.
FIG. 23 is a graph showing results of a wear test experimented upon a surface and inside portion of the aluminum alloy having the chemical compositions shown in FIG. 22, which is molded according to the present embodiment.

FIG. 22 shows a chemical composition of Al—Si aluminum alloys. FIG. 23 shows results of a wear test experimented upon a surface and inside portion of aluminum alloy having the chemical compositions shown in FIG. 22, which is molded according to the present embodiment.

The Al—Si aluminum alloys having the chemical composition of FIG. 22 are semi-solid to the solid phase rate of 30%, stirred, injected to a mold, and the wear resistance test is experimented with the following test conditions.

(Test Conditions)

Wear test method: ring-on-disc type

Ring material: Scr420 complying with the JIS

Disk material: aluminum alloy material manufactured according to the present embodiment (with T6 heating process performed)

Surface pressure: 190 kg/cm$^2$ lubrication oil: equivalent to engine oil 5W30 complying with Society of Automotive Engineers (SAE) number Temperature: 100° C.

Sliding distance: 5000 m

As shown in FIG. 23, by including silicon to the disc material manufactured according to the present embodiment, the surface portion shows better wear resistance compared to the internal portion.

As set forth above, according to the manufacturing method of parts formed by the semi-solid injection molding, a layer consisting of a liquid phase portion is partially molded in a predetermined portion of molded parts, which is molded by injecting semi-solid alloy material consisting of a solid phase portion and a liquid phase portion into a mold. By virtue of the foregoing feature, it is possible to constructively arrange a liquid phase portion to those portions that require high corrosion resistance such as a surface portion of the parts formed by the semi-solid injection molding, in order to improve corrosion resistance and wear resistance, and readily obtain molded parts having different material characteristics between the surface and inside the parts.

Furthermore, a layer consisting of the liquid phase portion can be partially molded at a predetermined portion of molded parts by placing a filter material in a predetermined position inside the mold and trapping the solid phase portion at the time of injecting semi-solid alloy material. By virtue of this, a liquid phase portion can be assuredly arranged to those portions where high corrosion resistance is particularly required, such as the surface of the parts formed by the semi-solid alloy molding. Also corrosion resistance and wear resistance can be enhanced by the above feature.

The present invention is not limited to the above embodiments and various changes and modifications can be made within the spirit and scope of the present invention. Therefore, to appraise the public of the scope of the present invention, the following claims are made.

What is claimed is:

1. A method of manufacturing a molded part, comprising:

cutting and granulating a plasticized solid magnesium alloy material into pellets;

forming the pellets into a semi-solid state material, the semi-solid state material including a liquid phase and a solid-phase, the semi-solid state material having 50% or less of a solid phase rate and a particle size of the solid phase being set to be equal to or less than one fiftieth a thickness of the molded part by stirring the pellets by using a semi-solid injection molding machine having a cylinder, an injection nozzle of which the diameter is smaller than that of the cylinder, and a screw for stirring the pellets in the cylinder to be brought into the semi-solid state material;

injecting the semi-solid state material into a mold;

distributing the liquid phase in an outer layer of said molded part and distributing the solid phase and the liquid phase in an inner layer of said molded part, whereby a layer of said molded part has the outer layer being formed by the liquid phase and the inner layer being formed by the solid phase and the liquid phase;

coagulating said injected semi-solid state material in the mold after said distributing; and removing the molded part from the mold, the molded part constituting a finished article.

2. The method according to claim 1, further comprising:

forming a layer in the outer layer of said molded part, the layer including a larger amount of aluminum than an amount of aluminum of the inner layer of said molded part.

3. The method according to claim 2, wherein said plasticized solid magnesium alloy material includes 6% to 10% of aluminum by weight.

4. The method according to claim 3, wherein said plasticized solid magnesium alloy material includes 6.5% to 7.5% of aluminum by weight.

5. A method of manufacturing a molded part, comprising:

cutting and granulating a plasticized solid aluminum alloy material into pellets;

forming the pellets into a semi-solid state material, the semi-solid state material including a liquid phase and a solid phase, the semi-solid state material having 50% or less of a solid phase rate and a particle size of the solid phase being set to be equal to or less than one fiftieth a thickness of the molded part by stirring the pellets by using a semi-solid injection molding machine having a cylinder, an injection nozzle of which the diameter is smaller than that of the cylinder, and a screw for stirring the pellets in the cylinder to be brought into the semi-solid state material;

injecting the semi-solid state material into a mold;

distributing the liquid phase in an outer layer of said molded part and distributing the solid phase and the liquid phase in an inner layer of said molded part, whereby a layer of said molded part has the outer layer being formed by the liquid phase and the inner layer being formed by the solid phase and the liquid phase;

coagulating said injected semi-solid state material in the mold after said distributing; and removing the molded part from the mold, the molded part constituting a finished article.

6. The method according to claim 5, wherein said plasticized solid aluminum alloy material includes 6% to 12% of silicon by weight.

7. The method according to claim 1, wherein said molded part is a wheel comprising an automobile wheel.

8. The method according to claim 1, wherein the cutting and granulating of the plasticized solid magnesium alloy material into pellets comprises:

forming a solid alloy using a magnesium alloy having strontium;

performing a plasticizing process on said solid alloy to form the plasticized solid magnesium alloy material; and cutting and granulating the plasticized solid magnesium alloy material into a pelletized state.

9. The method according to claim 5, further comprising:

forming a layer in the outer layer of the molded part, the layer including a larger amount of silicon than an amount of silicon of the inner layer of the molded part.

* * * * *

UNITED STATES PATENT AND TRADEMARK OFFICE

CERTIFICATE OF CORRECTION

PATENT NO. : 6,564,854 B1
DATED : May 20, 2003
INVENTOR(S) : Nobuo Sakate et al.

It is certified that error appears in the above-identified patent and that said Letters Patent is hereby corrected as shown below:

Column 2,
Line 8, change “one” to -- are --;
Line 38, change “half-molten” to -- semi-solid --.

Column 4,
Line 49, change “half-molten” to -- semi-solid --.

Column 5,
Line 51, after “that” insert -- is --.

Column 9,
Line 36, change “is are” to -- are --;
Line 43, after “A1” insert -- contents --.

Column 10,
Lines 41, 43 and 53, change “consisting of” to -- comprising --;
Line 61, change “alloy” to -- injection --.

Signed and Sealed this

Twenty-second Day of June, 2004

JON W. DUDAS
*Acting Director of the United States Patent and Trademark Office*